US011320215B2

(12) United States Patent
Harris et al.

(10) Patent No.: US 11,320,215 B2
(45) Date of Patent: May 3, 2022

(54) RADIATOR INCLUDING THERMAL STRESS COUNTERMEASURE

(71) Applicant: DENSO International America, Inc., Southfield, MI (US)

(72) Inventors: Justin Harris, Royal Oak, MI (US); Nikolai Akinin, Canton, MI (US)

(73) Assignee: DENSO International America, Inc., Southfield, MI (US)

( * ) Notice: Subject to any disclaimer, the term of this patent is extended or adjusted under 35 U.S.C. 154(b) by 0 days.

(21) Appl. No.: 16/450,414

(22) Filed: Jun. 24, 2019

(65) Prior Publication Data

US 2020/0400389 A1 Dec. 24, 2020

(51) Int. Cl.
*F28F 9/02* (2006.01)
*F28D 1/053* (2006.01)

(52) U.S. Cl.
CPC ..... *F28F 9/0268* (2013.01); *F28D 1/05366* (2013.01); *F28F 2265/00* (2013.01)

(58) Field of Classification Search
CPC ..... F28F 9/0268; F28F 9/0265; F28F 9/02; F28F 2265/00; F28F 9/028; F28F 9/026; F28F 9/0263; F28D 1/05366; F28D 1/053
See application file for complete search history.

(56) References Cited

U.S. PATENT DOCUMENTS 673,767 A * 4/1900 Eycleshymer
2,768,814 A * 10/1956 Frey ..... F28D 9/00 165/139
4,452,216 A * 6/1984 Patchen, II ..... F02B 29/0462 123/563
5,163,716 A 11/1992 Bolton et al.
5,209,209 A 5/1993 Karlsson et al.
5,597,047 A 1/1997 Thompson et al.
5,660,149 A 8/1997 Lakerdas et al.
5,975,193 A 11/1999 Tokita et al.
6,154,960 A 12/2000 Baldantoni et al.
6,158,500 A 12/2000 Heine
2002/0070003 A1 6/2002 Lenz et al.
2005/0092470 A1 5/2005 Heine
2006/0090878 A1 5/2006 Levasseur et al.
2008/0190592 A1* 8/2008 Bruck ..... F02M 26/32 165/159

(Continued)

FOREIGN PATENT DOCUMENTS

EP 0969189 A1 1/2000
GB 634608 A * 3/1950 ..... F28D 7/16

(Continued)

*Primary Examiner* — Harry E Arant
(74) *Attorney, Agent, or Firm* — Harness, Dickey & Pierce, P.L.C.

(57) ABSTRACT

A tank for a radiator. The tank includes an inlet port through which coolant enters the tank. A wall at least partially defines a cavity in fluid communication with the inlet port. A curved surface of the wall is opposite to the inlet port and reduces volume of the cavity at the inlet port. The curved surface is configured to reduce turbulence of coolant flowing into the cavity from the inlet port. At least one turning vane extends along the wall into the cavity from the inlet port. The at least one turning vane is curved to reduce turbulence of coolant flowing through the inlet port and into the cavity.

12 Claims, 3 Drawing Sheets

(56) References Cited

U.S. PATENT DOCUMENTS

| | | | | |
|---|---|---|---|---|
| 2014/0166249 | A1* | 6/2014 | Goenka | F28D 1/05366 165/148 |
| 2014/0231057 | A1* | 8/2014 | Schalansky | F28F 3/048 165/169 |
| 2017/0198988 | A1* | 7/2017 | Herring | F28F 9/0246 |

FOREIGN PATENT DOCUMENTS

| | | | | | |
|---|---|---|---|---|---|
| JP | H0953592 | A | | 2/1997 | |
| JP | 2014020588 | A | * | 2/2014 | F28D 1/05366 |

* cited by examiner

RADIATOR INCLUDING THERMAL STRESS COUNTERMEASURE

FIELD

The present disclosure relates to a radiator including a thermal stress countermeasure.

BACKGROUND

This section provides background information related to the present disclosure, which is not necessarily prior art.

While existing radiators are suitable for their intended use, they are subject to improvement. For example, existing radiators sometimes include complex and expensive countermeasures to prevent issues that may occur when the radiator is subject to excess thermal stress. Examples of such countermeasures include manufacturing the radiator tubes of higher strength material, or adding additional strength to the tubes by brazing inserts into the tubes to provide extra structure. Both of these options increase the cost of the radiator, and the tube inserts reduce performance. The present disclosure advantageously includes improved thermal stress countermeasures that are more cost effective and easier to assemble, for example. One skilled in the art will appreciate that the present disclosure provides numerous additional advantages and unexpected results as well.

SUMMARY

This section provides a general summary of the disclosure, and is not a comprehensive disclosure of its full scope or all of its features.

The present disclosure includes a tank for a radiator. The tank includes an inlet port through which coolant enters the tank. A wall at least partially defines a cavity in fluid communication with the inlet port. A curved surface of the wall is opposite to the inlet port and reduces volume of the cavity at the inlet port. The curved surface is configured to reduce turbulence of coolant flowing into the cavity from the inlet port. At least one turning vane extends along the wall into the cavity from the inlet port. The at least one turning vane is curved to reduce turbulence of coolant flowing through the inlet port and into the cavity.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
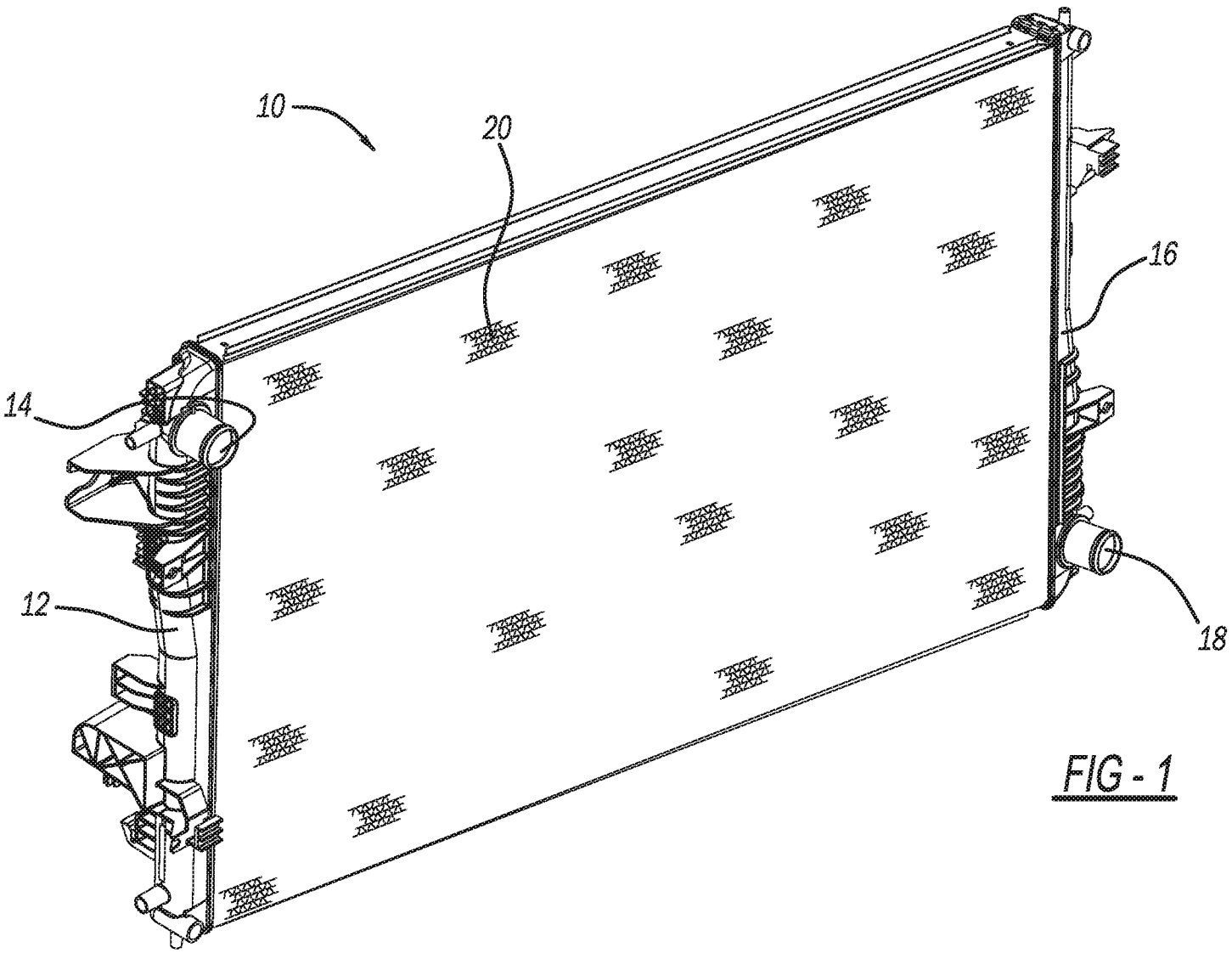
FIG. 1 is a perspective view of a radiator including thermal stress countermeasures in accordance with the present disclosure.

FIG. 1 illustrates a radiator in accordance with the present disclosure at reference numeral 10. The radiator 10 can be any suitable radiator configured for use in any suitable engine cooling application. The radiator 10 may be used to cool the engine of any suitable vehicle, such as any suitable passenger vehicle, mass transit vehicle, utility vehicle, recreational vehicle, construction vehicle/equipment, military vehicle/equipment, watercraft, aircraft, etc. The radiator 10 may be configured for use in any suitable non-vehicular engine cooling applications as well.

The radiator 10 includes an inlet tank 12 having an inlet port 14, through which any suitable coolant is introduced into the radiator 10. The radiator 10 further includes an outlet tank 16 having an outlet port 18, through which coolant exits the radiator 10. The inlet tank 12 and the outlet tank 16 may be made of any suitable material, such as any suitable polymeric material. Extending between the inlet tank 12 and the outlet tank 16 are a plurality of tubes 20, through which coolant flows between the inlet tank 12 and the outlet tank 16.

Figure 2:
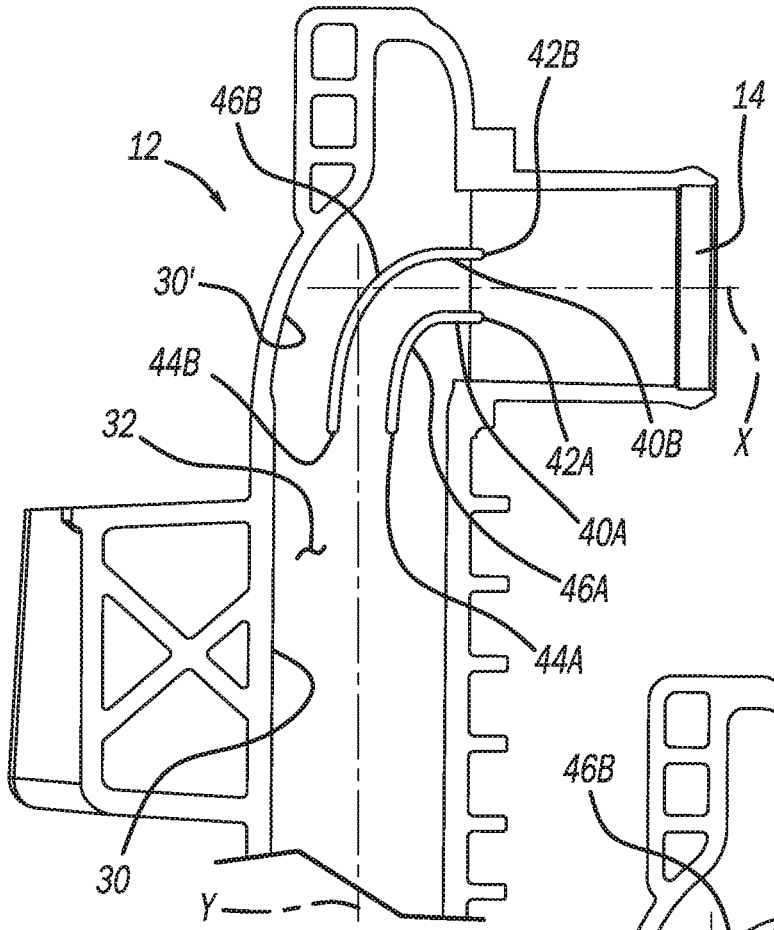
FIG. 2 is a cross-sectional view of a tank of the radiator including thermal stress countermeasures in accordance with the present disclosure.

With additional reference to FIG. 2, the inlet tank 12 will now be described in greater detail. The inlet tank 12 includes one or more walls 30, which define a cavity 32. Coolant flowing through the inlet port 14 flows into the cavity 32. The inlet port 14 extends along a longitudinal axis X. The cavity 32 has a length extending along a longitudinal axis Y. The inlet port 14 extends at an angle (such as at a 90° angle) relative to the length of the cavity 32. The longitudinal axis X of the inlet port 14 intersects (and is generally perpendicular to) the longitudinal axis Y of the cavity 32. Thus coolant entering the cavity 32 through the inlet port 14 must make a 90° turn as the coolant transitions from the inlet port 14 into the cavity 32. In existing radiators, this 90° turn creates a great amount of turbulence in the coolant, which can result in poor flow distribution and an undesirable high pressure drop.

To reduce turbulence of the coolant as the coolant enters the cavity 32 from the inlet port 14, the wall 30 of the inlet tank 12 includes a curved surface 30' in accordance with the present disclosure. The curved surface 30' curves inward towards the axis Y and the inlet 14 such that an upper portion of the curved surface 30' is closer to the axis Y than a lower portion of the curved surface 30'. Due to the presence of the curved surface 30', the volume of the cavity 32 proximate to the inlet port 14 is less than the volume of the cavity 32 distal to the inlet port 14. As coolant enters the cavity 32 through the inlet port 14 and flows along the curved surface 30', the coolant becomes less turbulent and flows more smoothly to the remainder of the cavity 32, which lowers the pressure drop and reduces thermal stress on the radiator 10. The reduced volume of the cavity 32 proximate to the inlet port 14 due to the curved surface 30' also advantageously slows the coolant and reduces turbulence. The curved surface 30' may have any suitable curvature. For example, the curvature of the curved surface 30' may be the same as, or approximately the same as, the curvature of the turning vanes 40A, 40B, 40C described herein. The curved surface 30' is in contrast to previous radiator inlet tanks, which did not include the curved surface 30', but instead had a 90° corner.

To further reduce turbulence of the coolant as the coolant enters the cavity 32 from the inlet port 14, the present disclosure advantageously includes one or more turning vanes where the inlet port 14 and the cavity 32 meet. In the example of FIG. 2, two turning vanes 40A and 40B are illustrated. Any other suitable number of vanes may be included, such as one or more vanes. The turning vanes 40A/40B can be formed in any suitable manner, such as molded with the polymeric inlet tank 12. Thus the vanes 40A/40B can be monolithic with the inlet tank 12. The vanes 40A/40B can be formed in any other suitable manner as well.

Each one of the vanes 40A and 40B includes a first end 42A/42B and a second end 44A/44B. The first ends 42A/42B are arranged, in the example of FIG. 2, where the inlet port 14 meets the cavity 32. From the first ends 42A/42B the vanes 40A/40B extend into the cavity to the second ends 44A/44B. The vanes 40A/40B may extend any suitable distance into the cavity 32. Between the first end 42A and the second end 44A of the vane 40A is a curved intermediate portion 46A. Between the first end 42B and the second end 44B is a curved intermediate portion 46B of the vane 40B. The vanes 40A/40B may be continuously curved, or include a combination of both curved and straight portions to guide coolant along the 90° transition from the inlet port 14 to the cavity 32.

Figure 3:
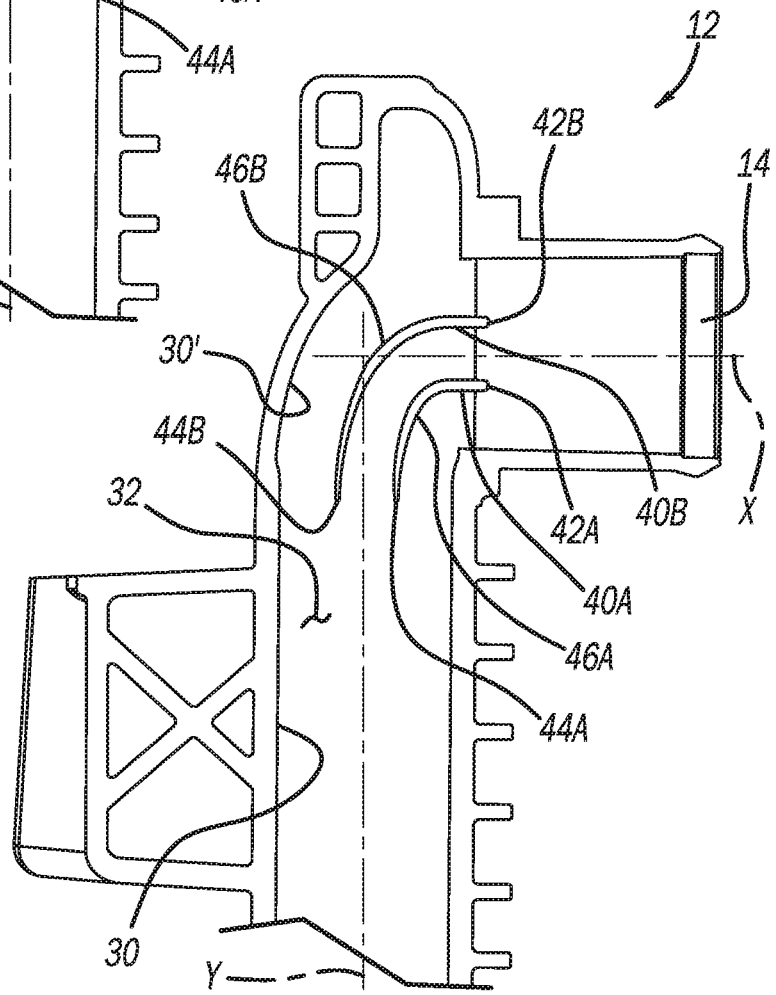
FIG. 3 is a cross-sectional view of the tank of the radiator including alternative thermal stress countermeasures in accordance with the present disclosure.
Figure 4:
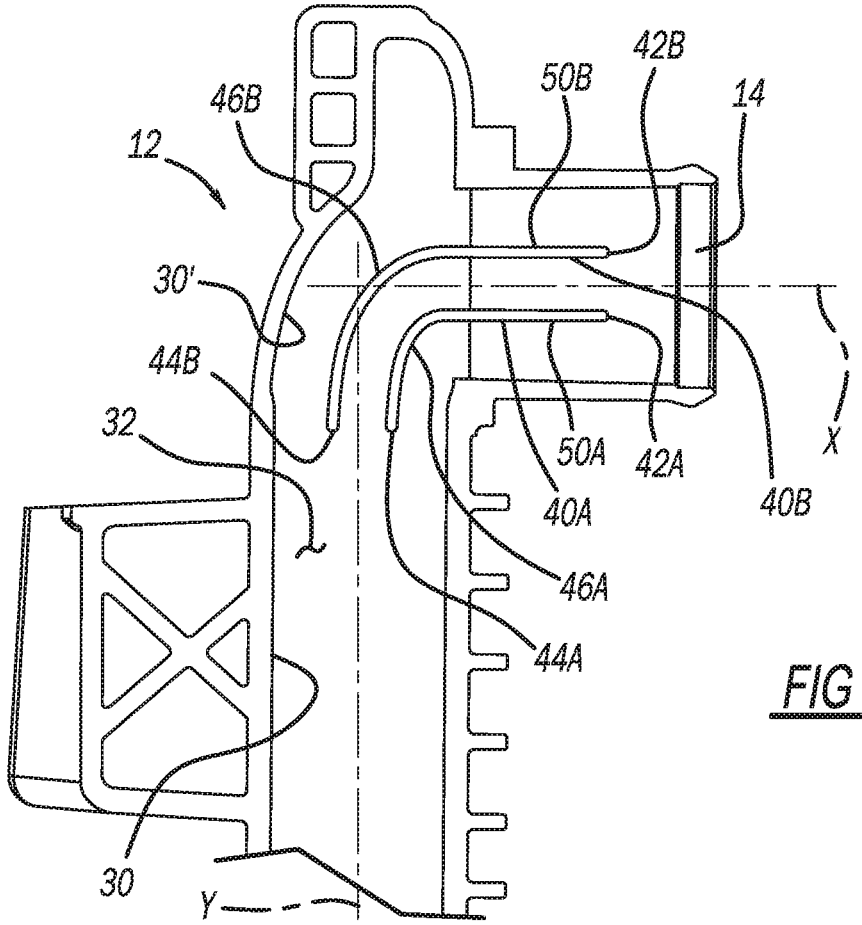
FIG. 4 is a cross-sectional view of the tank of the radiator including additional thermal stress countermeasures in accordance with the present disclosure.

With reference to FIG. 3, the vanes 40A/40B may taper along the lengths thereof, such that at the second ends 44A/44B the vanes 40A/40B are most narrow. With reference to FIG. 4, the vanes 40A/40B may extend further into the inlet port 14 to include generally planar portions 50A/50B, which extend generally parallel to the longitudinal axis X within the inlet port 14. Thus in the example of FIG. 4, the vanes 40A and 40B extend along the wall 30 of the cavity 32 and along an interior wall of the inlet port 14. By extending further into the inlet port 14, the vanes 40A/40B advantageously further reduce turbulence in the coolant.

The turning vanes 40A/40B advantageously reduce turbulence in the coolant as the coolant flows from the inlet port 14 into the cavity 32, thereby advantageously improving flow distribution of the coolant and lowering pressure drop. Reducing coolant turbulence and improving flow distribution also advantageously reduces thermal stress on the radiator 10, such as at the tubes 20. As a result, previously used thermal stress countermeasures, such as increasing the strength of the tubes 20 by using a higher strength (and more expensive) material, or adding strength to the tubes 20 by brazing inserts in the tubes 20 to provide extra structure, can be eliminated. Eliminating these previously used thermal stress countermeasures advantageously reduces the cost of the radiator 10, improves performance of the radiator 10, and simplifies manufacturing of the radiator 10. The vanes 40A/40B can advantageously be provided as part of a retrofit to existing radiators by replacing the inlet tank of an existing radiator with the inlet tank 12 including the vanes 40A/40B in accordance with the present disclosure. One skilled in the art will appreciate that the present disclosure provides numerous additional advantages and unexpected results.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A tank for a radiator, the tank comprising:

an inlet port through which coolant enters the tank, the inlet port extending along a first longitudinal axis;

a wall at least partially defining a cavity in fluid communication with the inlet port, the cavity extending along a second longitudinal axis that is perpendicular to the first longitudinal axis;

a curved surface of the wall opposite to the inlet port, the curved surface is aligned with the first longitudinal axis and configured to reduce turbulence of coolant flowing into the cavity from the inlet port; and at least one turning vane including a first end extending into the inlet port parallel to the first longitudinal axis, and a second end extending parallel to the second longitudinal axis, between the first end and the second end is a curved portion extending along the wall into the cavity from the inlet port to reduce turbulence of coolant flowing through the inlet port and into the cavity, the curved portion and the curved surface of the wall opposite to the inlet port each have a radius of curvature that is substantially similar;

wherein the first end of the at least one turning vane extends through less than an entirety of the inlet port; and wherein the curved surface has a curvature that is the same as a curvature of the at least one turning vane.

2. The tank of claim 1, wherein the tank is make of a polymeric material.

3. The tank of claim 1, wherein at the inlet port the cavity has a first volume that is less than a second volume of the cavity distal to the inlet port.

4. The tank of claim 1, wherein the at least one turning vane is molded along with the tank such that the at least one turning vane is monolithic with the tank.

5. The tank of claim 1, wherein the at least one turning vane tapers inward as the at least one turning vane extends from the inlet port into the cavity.

6. The tank of claim 1, wherein the at least one turning vane is curved to lower coolant pressure drop and reduce thermal stress on the tank.

7. A radiator comprising:

an inlet tank including an inlet port through which coolant enters the inlet tank, a wall at least partially defining a cavity in fluid communication with the inlet port, a curved surface of the wall opposite to the inlet port and aligned with the first longitudinal axis, and a turning vane extending along the wall into the cavity from the inlet port, the curved surface and the turning vane are curved to reduce turbulence of coolant flowing through the inlet port and into the cavity;

an outlet tank including an outlet port through which coolant exits the outlet tank; and a plurality of tubes extending between the inlet tank and the outlet tank;

wherein the inlet port extends along a first longitudinal axis that is perpendicular to a second longitudinal axis extending along a length of the cavity; and wherein the turning vane includes a first end extending into the inlet port parallel to the first longitudinal axis, and a second end extending parallel to the second longitudinal axis, between the first end and the second end is a curved portion that is opposite to the curved surface, the curved portion and the curved surface each have a radius of curvature that is the same;

wherein the first end of the at least one turning vane extends through less than an entirety of the inlet port.

8. The radiator of claim 7, wherein at the inlet port the cavity has a first volume that is less than a second volume of the cavity distal to the inlet port.

9. The radiator of claim 7, wherein the inlet port is arranged about 90° relative to a length of the cavity.

10. The radiator of claim 7, wherein the turning vane is molded with the inlet tank such that the turning vane is monolithic with the inlet tank.

11. The radiator of claim 7, wherein the turning vane tapers inward as the turning vane extends from the inlet port into the cavity.

12. The radiator of claim 7, wherein the turning vane is curved to lower coolant pressure drop and reduce thermal stress on the tank.

* * * * *